US005540468A

United States Patent [19]

Fassman

[11] Patent Number: 5,540,468

[45] Date of Patent: Jul. 30, 1996

[54] DOOR OPENING AND CLOSING DEVICE FOR HANDICAPPED PERSONS

[76] Inventor: Arnold Fassman, 40 Oak St., Westport, Conn. 06880

[21] Appl. No.: 304,407

[22] Filed: Sep. 12, 1994

[51] Int. Cl.[6] ..... B65H 75/40; B66C 1/10

[52] U.S. Cl. ..... 294/1.1; 294/82.11; 224/162; 242/588.1

[58] Field of Search ..... 294/1.1, 82.1, 294/82.11, 25; 16/110 R, 114 R, 122; 242/588.1; 224/162, 164

[56] References Cited

U.S. PATENT DOCUMENTS

| | | | |
|---|---|---|---|
| 1,270,106 | 6/1918 | Bishop . | |
| 1,831,666 | 8/1929 | Jacobia . | |
| 2,732,148 | 11/1951 | Lummis | 242/107 |
| 2,776,644 | 6/1953 | Fontaine | 119/109 |
| 3,921,936 | 11/1975 | Suter | 242/588.1 |
| 3,968,670 | 7/1976 | Quenot | 70/456 R |
| 3,980,245 | 9/1976 | Delehoy | 242/588.1 |
| 4,202,510 | 5/1980 | Stanish | 242/107.4 R |
| 4,880,152 | 11/1989 | Trankle | 242/588.1 |
| 5,147,078 | 9/1992 | Flieder | 224/42.46 A |
| 5,173,067 | 12/1992 | Biba | 441/26 |
| 5,231,731 | 8/1993 | Jones, Jr. | 16/114 R |
| 5,231,733 | 8/1993 | Pittman | 16/114 R |
| 5,375,295 | 12/1994 | Woodward | 16/114 R |
| 5,388,877 | 2/1995 | Wenk | 294/1.1 |

*Primary Examiner*—Dean Kramer
*Attorney, Agent, or Firm*—Martin D. Wittstein

[57] ABSTRACT

A door opening and closing device for a handicapped person dependent on a wheel chair and or crutches for mobility is disclosed, which includes a housing generally sized for a person to hold in his hand, the housing having a peripheral opening. A reel is rotatably mounted within the housing, and an elongate flexible member is would on the reel and extends through the peripheral opening. A resilient member in the housing is interconnected between the housing and the flexible member such that it is stressed when the flexible member is withdrawn from the housing such that it will retract the flexible member back into the housing with the withdrawing force is removed. A grasping member is connected to the free end of the flexible member which has a configuration such that it will easily grasp the shaft housing of a conventional door knob and not slip off when the flexible member is pulled to open or close the door.

7 Claims, 6 Drawing Sheets

DOOR OPENING AND CLOSING DEVICE FOR HANDICAPPED PERSONS

BACKGROUND OF THE INVENTION

The present invention relates generally to the field of devices and apparatus to aid handicapped persons, and more particularly to a device for aiding handicapped persons who are dependent on wheelchairs or crutches for mobility in opening and closing doors before and after moving through the doorway.

It is generally recognized that handicapped persons face a variety of problems in dealing with the normal situations of everyday living that fully functional handicapped persons never encounter, although it is doubtful that the average fully functional handicapped person realizes the extent to which handicapped persons with certain types of handicaps are impaired or impeded by their disability from performing some of the most rudimentary tasks of daily life. Of course, it will be apparent that the extent to which a handicapped person is prevented from performing a particular task may depend largely on the type of handicap involved, since the vicissitudes of handicaps is such that each presents its own set of unique problems and challenges which the handicapped person must overcome as best as he can in his effort to be as fully functional as possible.

The present invention is primarily directed toward addressing a particular problem faced by handicapped persons who are confined to a wheel chair, although it also has significant utility in aiding handicapped persons who depend on crutches for mobility. While it is generally recognized that handicapped persons confined to a wheel chair will encounter certain problems that will restrict or impair their mobility, it is believed that the average handicapped person does not appreciate the many and varied relatively small but certainly not insignificant ways in which this mobility is greatly restricted or at least impaired by the need to perform certain tasks which either cannot be performed, or which can be only with great difficulty, by a handicapped person confined to a wheel chair. As a former engineer for a large manufacturer of office and other commercial products who has recently become dependent on a wheel chair and crutches for mobility, I have become intimately familiar with the great variety of problems encountered by such persons and have given considerable thought to developing practical solutions to these problems, from which the present invention emanates.

One of the most common tasks which must be performed by any person in the course of everyday living is that of opening and closing a door prior to entering or after leaving a room. It is quite obvious why a closed door must be opened, and there are numerous reasons for the necessity of closing a door after entering or leaving a room, for example, when security is necessary, privacy is desired, children or pets must be confined, the room is heated or air conditioned, various forms of noise or other sound, must be excluded from outside or confined within the room, and many others which can be imagined. Suffice it to say that in today's society the ability to open and close a door is such a fundamental necessity that few people ever consider the adverse consequences of not being able to do so. Yet, as will be more fully explained below, it is either very difficult and in some instances virtually impossible for a handicapped person in a wheel chair to open and close a door prior to and after moving through the doorway.

Although there are several possible situations which a person in a wheel chair or on crutches can encounter in connection with negotiating a doorway depending upon the architecture of the doorway (and these will be further discussed below), the most difficult situation encountered is that in which the he wishes to pass through the doorway in a direction opposite to that in which the door swings, or in other words, entering a room in which the door swings outwardly or leaving a room in which the door wings inwardly. In either of these situations, the handicapped person must approach the closed door in a forward or partly angled direction until he can reach out sufficiently far to grasp the door knob without running the risk of falling out of the wheel chair or losing his balance on the crutches. When he has reached and turned the door knob, he must then pull the door toward the wheel chair or himself, and he must also move backward until there is sufficient clearance between the wheel chair or the crutches and the arcuate path followed by the edge of the door while it is opening so that the door clears the front wheels of the wheel chair or the bottom of the crutches. At best this is a difficult maneuver for an agile handicapped person, and may be impossible for an aged, less agile person. Also, as he moves backwards in increments, he must take care not to lean so far forward to reach the door knob that he loses his balance and falls out of the wheel chair.

After the door is fully opened, the handicapped person then again approaches the doorway and begins to pass therethrough, but at this point the back of the wheel chair or the crutches are in the path of movement of the door as it moves toward a closed position, and therefore prevent it being pulled closed as the person moves further through the doorway. A non-handicapped person, at this point, would simply grasp the door knob and pull the door closed behind him as he moves through the doorway, usually by turning slightly while reaching behind to ensure that the door closes just as he passes through the doorway. The problem encountered by the handicapped person, however, is that after passing through the doorway sufficiently far to permit the door to swing shut without hitting either the wheel chair or the crutches, he can no longer reach the door knob or the edge of the door, even by turning around and stretching his arm as far as possible. This maneuver is at best very difficult for a young and adroit handicapped person, and virtually impossible for the more aged and less agile handicapped person. And, as will be seen in more detail below, if the handicapped person attempts to close the door in increments while he is moving through the doorway, he will encounter difficulty both in either simultaneously or alternately propelling the wheel chair or manipulating the crutches through the doorway and simultaneously pulling the door closed, and also from the limitation imposed on the extent of movement of the door before it strikes the rear edge of the main wheels of the wheel chair or one of the crutches, thus further impeding his effort to close the door.

One solution to this problem might appear, at first, to be that the handicapped person can maneuver the wheel chair into a 180° turn, or to turn himself around on the crutches, so that he now faces the door, and then move the wheel chair or walk forwardly until he can reach the door knob to pull the door closed. However, in the average situation, in order to reach the door knob without leaning so far forwardly that he may risk falling out of the chair or losing his balance on the crutches, either at least the forward part of the wheel chair or one of the crutches has moved back through the doorway and is in the room, with the result that the door cannot be shut before it will strike the foot rests of the wheel chair or one of the crutch. The handicapped person must now move the wheel chair or walk backwardly until the front edges of the foot rests or the crutch clear the door frame and then lean forward again to grasp the door knob and pull the door further toward a closed position. He may have to repeat this maneuver a couple of times depending on the width of the door. It will be apparent that this procedure requires considerable effort and dexterity, which even a substantially agile handicapped person may find difficult if not impossible to accomplish.

A relatively common complication added to the situation described above is where the door, by virtue of the architecture of the room and the door way, is free to swing 180° between a closed position and a fully open position, such as where the wall on either side of the doorway is disposed in a plane parallel to the doorway. In this situation, a handicapped person confined to a wheel chair or crutches is faced with the further difficulty that, in order to reach the door knob, he must now reach laterally in the plane of the doorway as well as reaching perpendicularly through the doorway. This maneuver is virtually impossible for any handicapped person with an average size door, and even with a narrow door which is just barely wide enough accommodate the wheel chair, he will still find it especially difficult to now swing the door away from the wall and in the arcuate path necessary to close it without the wheel chair or a crutch being in the doorway and obstructing free movement of the door between open and closed positions.

Although no distinction has been made in the foregoing discussion between the problems encountered by handicapped persons who utilize a wheel chair for mobility and those who depend on crutches, it should be understood that, although the nature of the problems is the same for both types of aid to mobility, the severity of those problems is much greater for the handicapped person in the wheel chair than for the handicapped person on crutches. The principle reasons for this difference is that the wheel chair physically occupies more cubic space then crutches and is usually more cumbersome to maneuver, although the area required for the arcuate path followed by the bottom of the crutches when walking with them approaches, if not equals, the area occupied by a wheel chair. Also, a handicapped person in a wheel chair, being confined to a sitting position in a device having substantially greater mass than a pair of crutches, is much less able to manipulate the wheel chair and position himself appropriately for the task at hand than the standing handicapped person who need only move his crutches. Therefore, in further discussion of the manner in which the present invention solves the foregoing problems and in the detailed description of the invention, emphasis is placed on the applicability of the invention to the handicapped person confined to a wheel chair.

SUMMARY OF THE INVENTION

The present invention at least considerably obviates if not entirely eliminates the foregoing problems in a manner which is effective to afford handicapped persons confined to a wheel chair or crutches the same degree of functionality in opening and closing doors as that possessed by non-handicapped handicapped persons.

In its broader aspects, the present invention has particular utility as a door opening and closing device adapted for use by handicapped persons confined to a wheel chair or depend on crutches for mobility and who are unable to easily open or close a door when approaching and after passing through the doorway in the wheel chair or on the crutches in a direction opposite to that in which the door swings open. In this environment, the door opening and closing device comprises a generally cylindrical housing having a thickness and peripheral extent such that it can conveniently be held in the hand of a user, and has an opening disposed on the periphery thereof. A reel is rotatably mounted within said housing, and an elongate flexible member is wound on the reel and extends through the peripheral opening in the housing. A suitable resilient member is mounted in the housing and is operatively interconnected between the housing and the flexible member such that the resilient member is stressed in response to movement of the flexible member through the peripheral opening in the housing to withdraw the flexible member from the housing, whereby the resilient member will retract the flexible member back into the housing through the peripheral opening in response to the stress in the resilient member when the force withdrawing the flexible member from the housing is removed. A grasping means is attached to the end of said flexible member, the grasping means having a configuration such that it will easily grasp the shaft housing of a door knob and not slip off when said flexible member is pulled to open or close the door, whereby the handicapped person can catch the grasping means over the door knob shaft housing on the adjacent side of a closed door while moving himself backward away from the door to open it, and can catch the grasping means over the door knob shaft housing on the adjacent side of an open door while passing through the doorway to pull the door closed after the wheel chair or the crutches clear the path of the door.

In some of its more limited aspects, the grasping means comprises a hook having a configuration such that it will easily catch over the shaft housing of a door knob and not slip off when the flexible member is pulled to open or close the door. In another embodiment, the grasping means is a claw having a configuration such that it can also catch over the shaft housing of the door knob and not slip off when the flexible member is pulled to open or close the door. And in a still further embodiment, the flexible member is an elongate strip of spring steel which has a sharp lateral curvature which provides sufficient rigidity that it will resist bending in the concave direction of the lateral curvature, and a loop of flexile material is attached to the end of the flexible member which can be dropped over a door knob when the flexible member is extended, thereby allowing the user to grasp a door knob with the opening and closing device without his having to physically engage the hook or the claw over the door knob.

A significant feature of the present invention is the provision of means for attaching the door opening and closing device to the hand or wrist of a user, or to a frame portion of the wheel chair, thereby leaving the user's hands free to manipulate the wheel chair or the crutches during the various movements hereinafter described which are necessary to open or close a door.

Having briefly described the general nature of the present invention, it is a principle object thereof to provide a door opening and closing device for handicapped persons who are dependent on a wheel chair or crutches for mobility which very effectively enables such persons to open or close doors which would otherwise be a difficult, if not virtually impossible, task.

It is another object of the present invention to provide a door opening and closing device for such handicapped persons which can be conveniently hand held or mounted on a hand, wheel chair or crutch to leave the user's hands free to manipulate the wheel chair or crutches, and can be operated with a minimum of agility.

It is a still further object of the present invention to provide a door opening and closing device for such handicapped persons which is designed to be highly effective for its intended purpose, is relatively inexpensive and long lasting, and requires virtually no care or maintenance.

These and other objects, features and advantages of the present invention will be more apparent from an understanding of the following detailed description of presently preferred embodiments thereof when considered in conjunction with the accompanying drawings.

DETAILED DESCRIPTION OF THE INVENTION

Figure 1:
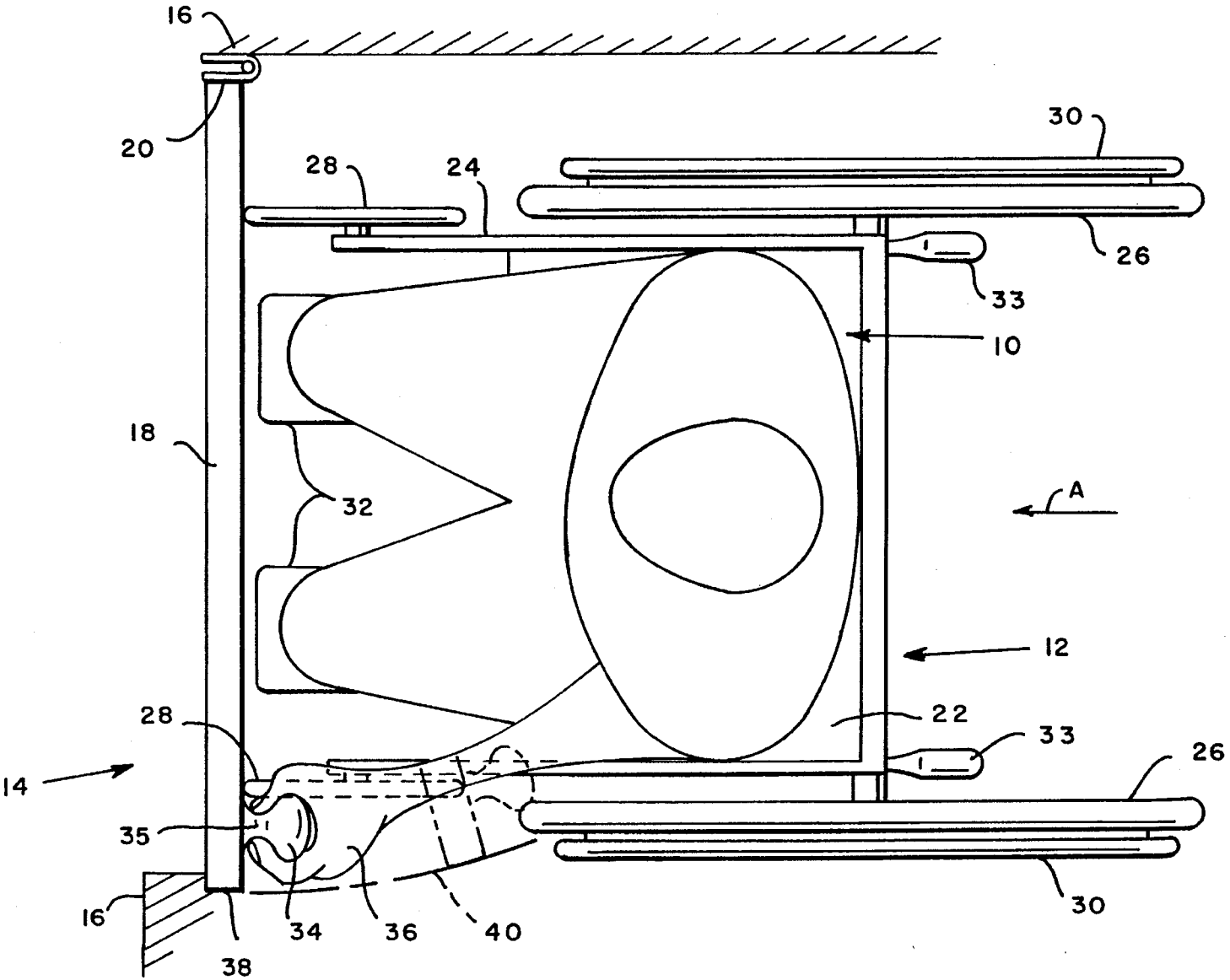
FIG. 1 (PRIOR ART)
FIG. 1 is a plan view representing a handicapped person sitting in a conventional wheel chair and illustrating the nature of the problems faced by such handicapped person in opening a door prior to passing through the doorway in a direction opposite to that in which the door swings open.

Referring now to the drawings, and particularly to FIG. 1 thereof, it will be seen that a handicapped person, indicated generally by the reference numeral 10, is seated in a wheel chair, indicated generally by the reference numeral 12, is attempting to move through a doorway, indicated generally by the reference numeral 14, which is defined by a suitable rectangular frame 16. A door 18 is mounted in the doorway 16 by suitable hinges 20 so as to swing either 90° or 180° between closed and open positions, depending on the architecture of the doorway 14 and adjacent walls, the door 18 swinging 90° in the doorway 14 showing in FIG. 1.

The wheel chair 12, which is of generally standard construction, includes a seat portion 22 mounted on a suitable frame 24 which is suitably supported by a pair of large main wheels 26 and a pair of forwardly disposed smaller front wheels 28, the latter being connected to the frame 26 by casters (not shown) so that they can swivel to facilitate steering the wheel chair 12. A circular drive rail 30 is connected to each main wheel by which the handicapped person turns the main wheels 26 to propel the wheel chair 12. The wheel chair 12 is also provided with a pair of forwardly disposed foot rests 32 mounted on the frame 24 adjacent the location of the front wheels 28 and which normally support the handicapped persons feet. In known manner, the foot rests 32 are attached to the frame 24 in such a manner that they can be raised to a vertical position and swung out of the way so that the handicapped person can rest his feet on the floor. A pair of handles 33 is also mounted on an upper portion of the frame 24 adjacent the main wheels 26 by which another person can push the wheel chair 12

FIG. 1 illustrates the problems faced by a handicapped person 10 in the wheel chair 12 attempting to open a door 18 and pass through the doorway 14. It should be understood that the problems hereinafter described are not standard, but rather are a little unique to each handicapped person depending upon the severity of his handicap, his physical size, the extent of his agility, the length of his arms, etc., and these factors should be kept in mind when considering these problems in the light of the drawings. The drawings, however, are representative of the nature of these problems to an average handicapped person and illustrate the problems with sufficient clarity that the varying degrees to which they affect different handicapped persons can be understood.

Still referring to FIG. 1, it will be seen that the handicapped person 10 has approached the door 18 in the direction of travel as indicated by the arrow A and wishes to pass through the doorway 14 to either enter or exit a room. As shown, the door 18 is mounted on the hinges 20 in such a manner that the door 18 swings toward the wheel chair 12. In order for the handicapped person 10 to reach the door knob 34 with his hand 36 while still remaining seated in a normal position in the wheel chair 12, he must propel the wheel chair 12 to a position where the foot rests 32 are closely adjacent to the adjacent face of the door 18. In this position it is immediately clear that the door 18 cannot be opened without striking the foot rests 32. The only way in which the handicapped person can open the door 18 is to pull the door 18 toward the wheel chair 12 in small increments while simultaneously moving the wheel chair 12 in the reverse direction until the forward edge of the foot rests 32 are clear of the arc of swing 40 of the free edge 38 of the door 18. Thereafter, he must maneuver the wheel chair 12 laterally of the door 18 toward the free edge 38 thereof until he is facing the free edge 38 of the door 18, so that he can now lean forward slightly and push the door 18 open far enough to propel the wheel chair though the doorway 14. Obviously, this is a cumbersome maneuver, even for a handicapped person with agility and strength, and very likely an extremely difficult maneuver for an aged, far less agile handicapped person. In addition, in the course of alternately moving the wheel chair 12 backwards and pulling the door 18 open far enough to maneuver around to the free edge 38 thereof, the handicapped person must take care not to lean so far forward that he loses his balance and falls forwardly out of the wheel chair. Even if he swings the foot rests 32 out of the normal position, his legs and knees will still interfere with the opening movement of the door and the above described procedure will still be necessary. Also, it should be understood that this maneuver is only possible if there is no wall on the side of the door 18 adjacent the free edge 38, such as might occur if the door is located at the end of a hallway; in this situation it would simply be impossible for the handicapped person to open the door.

Figure 2:
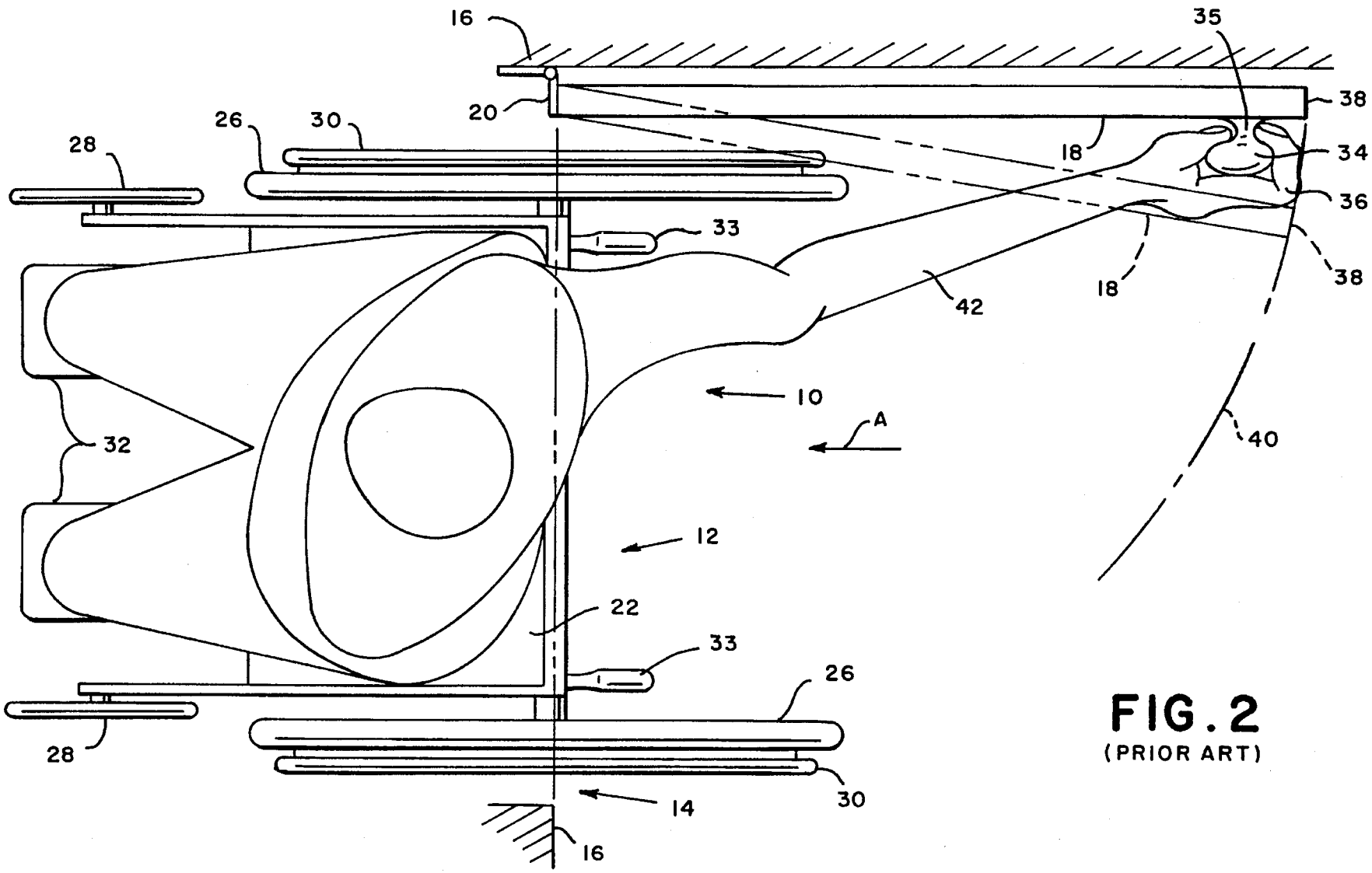
FIG. 2 (PRIOR ART)
FIG. 2 is a view similar to FIG. 1 but illustrating the nature of the problems faced in closing a door while passing through the doorway in the same direction.

FIG. 2 illustrates, in a similar manner, the problems encountered by a handicapped person in a wheel chair attempting to close a door while passing through the doorway in the same direction as that shown in the situation shown in FIG. 1. Thus, it will be seen that the handicapped person 10 has propelled the wheel chair 12 part way through the doorway 14 and wishes to close the door 18 behind him. As he turns slightly in the wheel chair 12 and extends his arm 42 as far as he can reach, his hand 36 will grasp the door knob 34 while the wheel chair 12 is still within the door way 14. The general nature and construction of wheel chairs is such that if the handicapped person propels himself entirely though the doorway 14, it will be entirely impossible for him to reach the door knob 34. As clearly seen, as soon as the handicapped person begins to pull the door 18 closed, it strikes the rear edge of the drive rail 30, thereby preventing further movement of the door. In a manner similar to that described above in connection with opening the door, the only way that the handicapped person can close the door is to propel the wheel chair 12 forwardly in small increments, pulling the door 18 with him to the extent permitted by the forward movement of the drive rail 30, and when the drive rail 30 clears the door, the main wheel 26. However, it will be seen that the further the door 18 closes, the further the free edge 38 thereof swings in the arc 40 to a position further behind the handicapped person to the point where he must now turn his body in the opposite direction and reach back and grasp the doorknob 34 with his other hand, and then continue to move forwardly in small increments while pulling the door 18 with him, until he has progressed far enough through the doorway 14 to close the door. Again, it will be apparent that this is an extremely cumbersome maneuver, even for a fairly agile handicapped person, and on which can easily be impossible for an aged, less agile, handicapped person.

It should now be apparent that there is critical need for a simple and effective device for handicapped persons who are confined to a wheel chair which will enable them to open and close doors with a minimum of effort so that their mobility will not be restricted by having to perform difficult or near impossible tasks.

Figure 3:
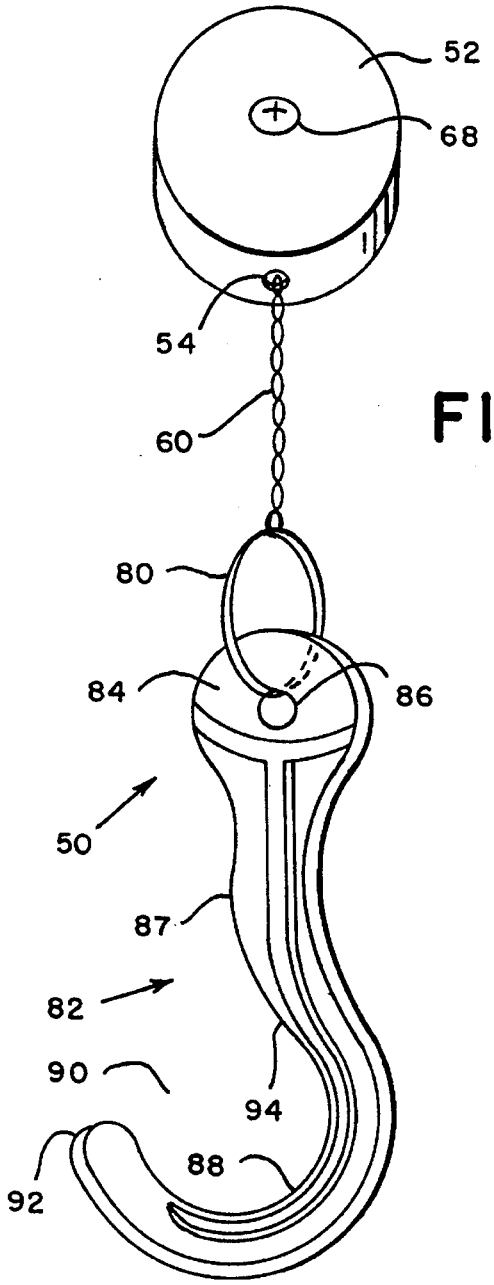
FIG. 3 is a perspective view of one embodiment of the door opening and closing device of the present invention.
Figure 4:
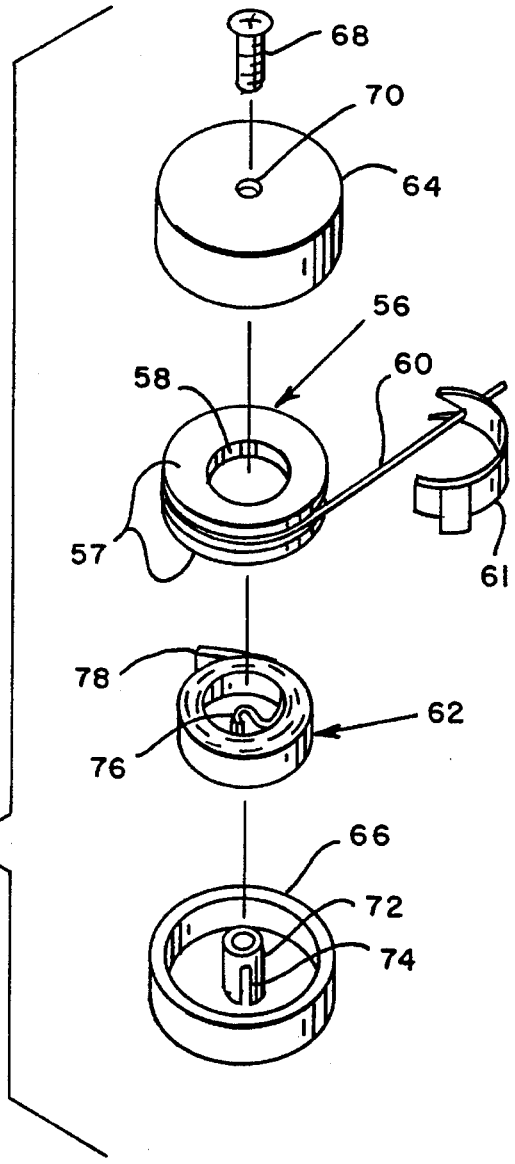
FIG. 4 is an exploded view of the housing, reel and resilient member that retracts the flexible member back into the housing after the withdrawal pulling force has been removed.

FIGS. 3 and 4 show one embodiment of my invention which is intended to solve the foregoing problems. The door opening and closing device of my invention is relatively simple in terms of mechanical construction, but as will be seen hereinafter is highly effective to perform the intended purpose. The door opening and closing device, indicated generally by the reference numeral 50, consists housing 52 which is generally, although not necessarily, cylindrical in configuration, the housing 52 having a thickness and peripheral extent such that it can conveniently be held in the hand 36 of the handicapped person 10. The housing 52 also has a peripheral opening 54. A suitable reel 56, which may either be merely a pair of opposed spaced apart disks 57 confined within the housing, or connected together by a hub 58, is rotatably mounted within the housing 52. A suitable flexible member 60, such as a link or bead chain, cord, thin wire, or elongate strip of metal, etc., is wound between the disks 57 or around the hub, depending on the nature of a resilient member next described; the flexible member extends through the peripheral opening 54. If desired, the door opening and closing device 50 may be provided with a brake member 61 which is mounted in the housing 52 in known manner to as to slide between locking and unlocking positions to either restrict or permit retracting movement of the flexible member 60 back into the housing 52 after having been withdrawn therefrom.

A resilient member 62, such as a coil spring or an elongate strip of spring steel, is mounted in the housing 52 and is suitably interconnected between the housing 52 and the flexible member 60. As seen in FIG. 4, the housing 52 is composed of a pair of shells 64 and 66 which are held together by a screw 68 passing through an aperture 70 on one shell and being threadedly engaged in a central upstanding post 72 formed on the other shell 66. The post 72 is provided with a slot 74 which receives a loop 76 the inner end of the resilient member 62, thereby connecting the resilient member 62 to the housing. If the resilient member 62 is a coiled spring, the other end 78 is suitably connected to the reel 56, and the reel would include the hub 58 on which the flexible member 60 would be wound. On the other hand, if the flexible member 62 is an elongate strip of spring steel, then the outer end 78 is suitably connected to the inner end of the flexible member 60, and the resilient member 62 obviate the need for the hub 58 since the flexible member 60 winds directly onto the resilient member 62.

The other end of the flexible member 60 is suitably connected to a grasping means which has a configuration such that it will easily grasp the shaft housing a door knob and not slip off when the flexible member 60 is pulled to open or close a door. One embodiment of such grasping means is shown in FIG. 3, wherein it is seen that the free end of the flexible member 60 is attached to a suitable ring 80, which in turn is attached to a hook, indicated generally by the reference numeral 82. The hook 82 preferably has a connecting tab 84 with an aperture 86 through which the ring 80 passes. The hook 82 also has a shank portion 87 which is generally elongate in configuration and a hook portion 88 that is approximately semicircular to define a substantially wide throat 90 between the terminal end 92 of the hook portion 88 and the approximate juncture 94 of the hook portion 88 with the shank portion 87. The configuration of the hook 82 is such that the length of the shank portion 87 is generally sufficient to permit the hook portion 88 to reach behind the door knob 34 and engage the shaft housing 35. Also, the throat 90 is sufficiently wide to encompass the shaft housing 35 of conventional door knobs.

Figure 5:
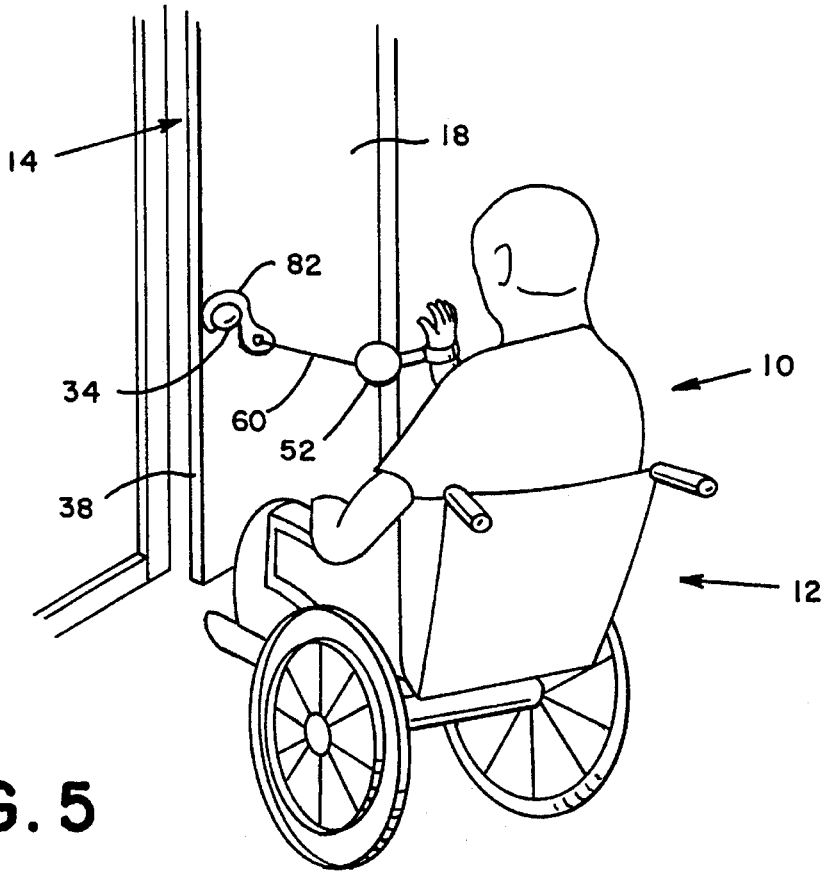
FIG. 5 is a view of a handicapped person using the door opening and closing device of the present invention to open a door that he has just approached to attach the device to the door knob, and is backing away far enough to allow the door to open.

In operation of the door opening and closing device just described, reference is made to FIG. 5 wherein it is seen that the handicapped person 10 has moved the wheel chair 12 up to the door 18 and has placed the hook 82 over the door knob 34 so that it is engaged around the door knob shaft housing 35, and has then moved the wheel chair 12 in the opposite direction a distance sufficient for the front of the foot rests 32 to clear the arc of movement 40 of the outer edge 38 of the door 18. While moving the wheel chair in the reverse direction, the flexible member 60 is withdrawn from the housing 52, and when the wheel chair has cleared the arc of swing 40 of the door edge 38, the handicapped person pulls on the flexible member 60 to open the door so that he can pass through the doorway. He then removes the hook 82 from the door knob 34 and allows the resilient member 62 to retract the flexible member 60 back into the housing 52.

The foregoing mode of operation assumes that there is sufficient resistance to movement of the door 18 to prevent it from moving in response to the stress developed in the resilient member 62 while the flexible member 60 is being withdrawn. If the door 18 does not have such resistance to movement and begins to move immediately when the handicapped person moves the wheel chair backwards, the face of the door 18 will scrape against the foot rests and perhaps the handicapped person's feet or knees. To prevent this, the handicapped person engages the brake 61 on the housing 52 and then manually pulls out part or all of the flexible member 60 while he is still adjacent to the door, and then moves the wheel chair backwards until it is clear of the arc of swing 40 of the door edge 38. He then releases the brake 61 which permits the resilient member 62 to pull the flexible member 60 back into the housing 52, thereby opening the door 18. The remainder of this mode of opening the door 18 is the same as described in the preceding paragraph.

Figure 6:
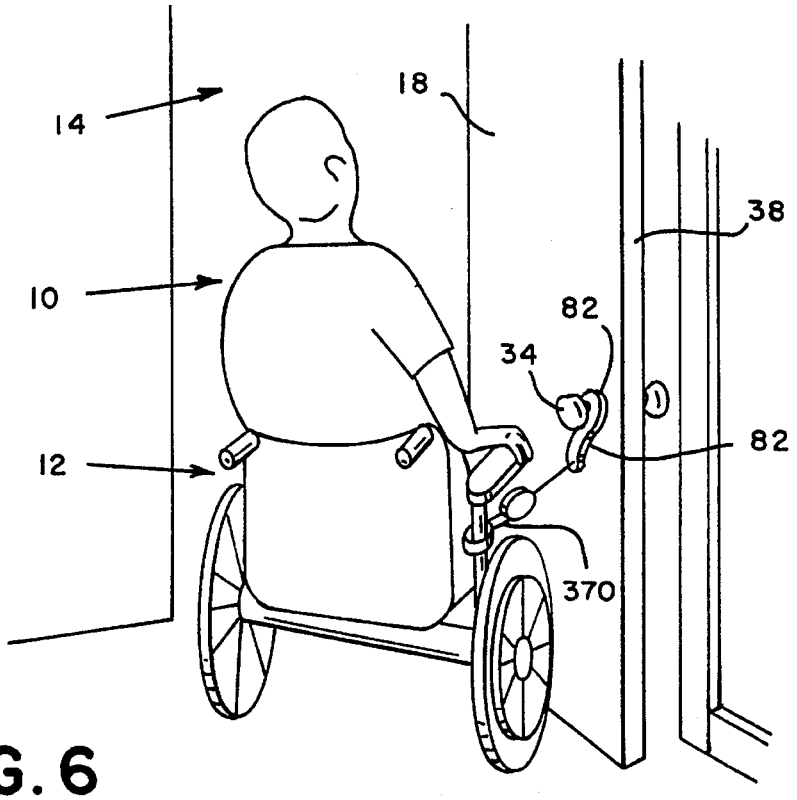
FIG. 6 is a view of a handicapped person using the door opening and closing device of the present invention to close a door to which he has just approached and connected the grasping means to the door knob.
Figure 7:
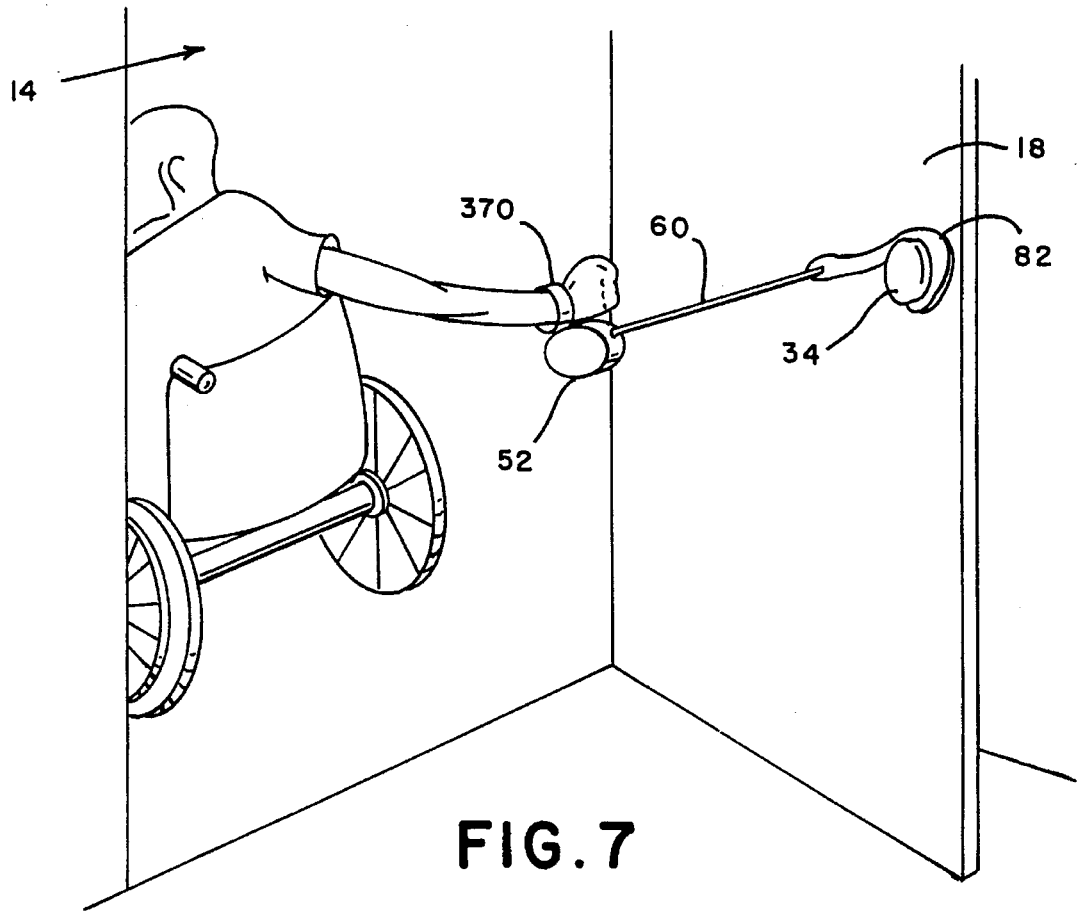
FIG. 7 is a view similar to FIG. 6 but showing the handicapped person having passed through the doorway and about to pull the door closed.

FIGS. 6 and 7 illustrate the mode of operation of the door opening and closing device 50 in closing a door after a handicapped person has moved through the doorway 14. In FIG. 6 it will be seen that the handicapped person has approached the door 18 and has placed the hook 82 over the door knob 34 so that it engages the door knob shaft housing 35 in the same manner as described above in connection with opening the door. He then moves the wheel chair through the doorway 14 to the position shown in FIG. 7, during which the flexible member 60 is withdrawn from the housing 52, which permits him to pass entirely through the doorway 14 without interference from the door 18. From the position shown in FIG. 7, it will be apparent that it is now a relatively simple task for the handicapped person to pull on the flexible member 60 to close the door.

Because of the very shallow angle between the plane of the door 18 and the direction of the flexible member 60, it is unlikely that the door 18 will begin to move toward the closed position from the relatively light pulling force exerted by the resilient member 62. If it does, however, the handicapped person merely engages the brake 61 and follows the same procedure as described above for preventing the door 18 from moving prematurely in the opening direction.

Figure 8:
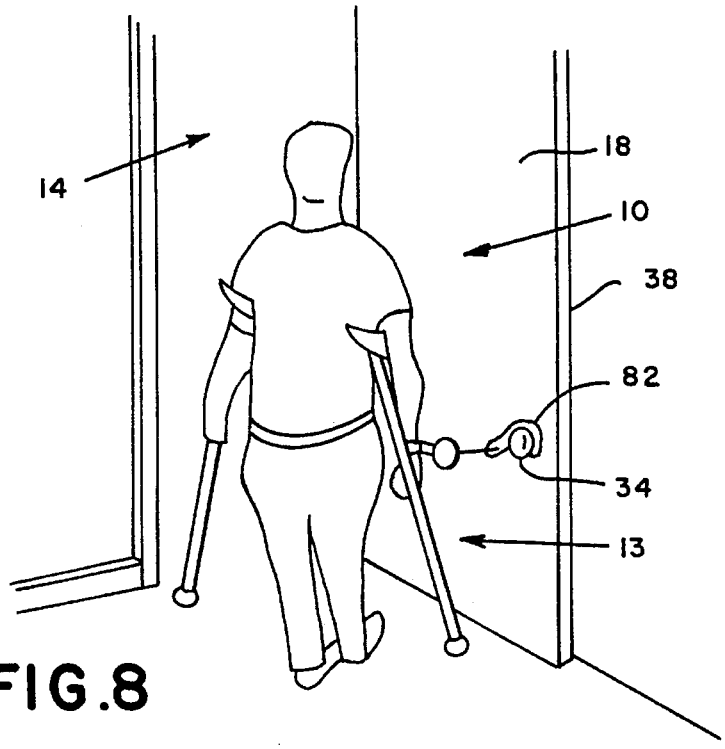
FIG. 8 is a view similar to FIG. 6 but showing the handicapped person in crutches rather than in the wheel chair.

FIG. 8 illustrates a handicapped person 10 on crutches, indicated generally by the reference numeral 13, engaging the door opening and closing device of the present invention with a door 18 which he has already approached and opened in much the same manner as that illustrated in FIG. 5 for the person in the wheel chair, and is about to pass through the doorway 14 in the same manner as that illustrated in FIGS. 6 and 7. Thus, it can readily be seen that the handicapped person on crutches faces much the same problems in opening and closing a door as the person in a wheel chair, with perhaps not the same degree of severity, in that the person on crutches still has to keep the bottom tips of the crutches sufficiently far from the edge 38 of the door 18 so that the door does not hit the bottom of the crutches, which could throw the handicapped person off balance and cause him to fall. By engaging the hook 82 with the door knock shaft 35 as above described, and then walking through the doorway, the door 18 will follow in the same manner as that described above in connection with FIG. 7.

Figure 9:
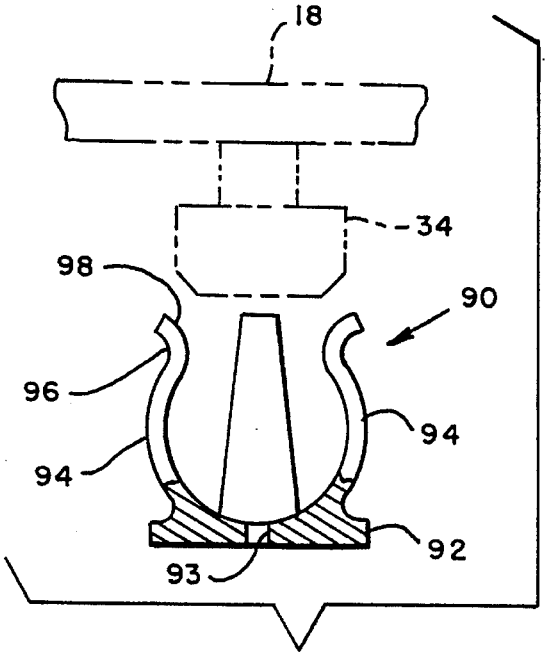
FIG. 9 is a fragmentary view of another embodiment of the door opening and closing device of the present invention showing only the door knob grasping means.

FIG. 9 illustrates another embodiment of the door opening and closing device of the present invention, in which the grasping means at the end of the flexible member 60 comprises a claw, indicated generally by the reference numeral 90, which is intended to grasp the door knob 34 to enable the handicapped person to pull the door 18 open or closed. The claw 90 has a suitable body member 92 which may have any desired configuration, such as the flat disc shown in the drawing or any desired shape of solid object that can be conveniently grasped by a hand. An opening 93 is provided in the body member 92 to permit the flexible member 60 to be attached thereto; it will be understood that the flexible member 60 can be suitably attached to any shape of body member 92. A plurality of inwardly curved resilient fingers 94 are suitable attached to or formed integrally with the body member 92, each of the fingers having a reverse bend portion 96 adjacent the free end thereof. The inner surface 98 of each of the reverse bend portions 96 form camming surfaces which are adapted to bear against the outer surface of the door knob 34 when the claw 90 is pressed against the door knob 34 to cause the reverse bend portions 96 of the fingers 94 to pass over the door knob 34 and press inwardly on the rear portion of the door knob 34 so that the resilient fingers 94 encompass the door knob 34 with sufficient strength that the claw 90 will pull the door 18 open or closed, as the case may be, when the flexible member 60 is pulled by the handicapped person.

In operation, the handicapped person would approach the closed or open door, press the body member 92 against the door knob 34 until the resilient fingers 94 spread apart sufficiently far to permit the reverse bend portions 96 of the fingers 94 to grasp the rear portion of the door knob 34, after which the door 18 is opened or closed in the manners described above. After the door has been opened or closed, as the case may be, the claw 90 is pulled off of the door knob 34 and the flexible member will then retract into the housing 52.

Figure 10:
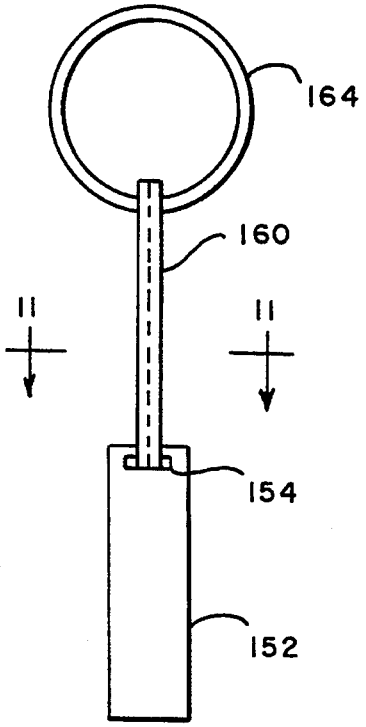
FIG. 10 is a view of still another embodiment of the door opening and closing device of the present invention.
Figure 11:
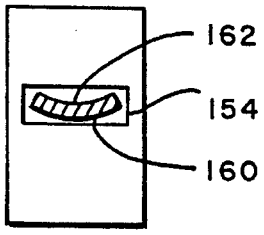
FIG. 11 is a sectional view of the flexible member of the embodiment shown in FIG. 10, taking on the line 11—11 of FIG. 10.

FIG. 10 illustrates still another embodiment of the door opening and closing device of the present invention, in which the flexible member 60 of the previous embodiment is now in the form of a continuous strip of spring steel 160 which is wound in the housing 152 and which can be withdrawn therefrom through the peripheral slot 154. As seen in the sectional view in FIG. 11, the flexible member 160 is formed with a rather steep lateral curvature 162 formed therein which provides the flexible member 160 with a substantial amount of rigidity against bending in the concave direction of the flexible member. A short loop of any suitable flexible material 164 is secured to the free end of the flexible member 160, the loop of material having an opening large enough to enable it to be easily dropped over a door knob to grasp the rear side thereof.

The laterally bent configuration of the flexible member is quite similar to that found in conventional tape measures, typically in the six to 12 foot length range, for the purpose of lending rigidity to the tape to facilitate measuring without the need to hold both ends of the tape. This principle is being utilized in this embodiment of the present invention to enable a handicapped person to grasp the door knob of a closed or open door without actually moving the wheel chair 12 to a position where he can reach the door knob with his hand 36. For example, with this embodiment, the handicapped person can move the wheel chair 12 entirely through the doorway and then turn around so that he is facing the open door, extend the flexible member 160 to the desired length, drop the loop 164 over the door knob and pull the door closed. This procedure eliminates the necessity of the handicapped person having to reach around behind himself at an awkward angle, as is seen in FIG. 7, to initiate the door closing procedure. Also, if the handicapped person is approaching a door that is slightly ajar but still sufficiently closed to block his path, he can stop short of the arc of swing of the door, extend the flexible member 160 until the loop 164 drops over the door knob and pull the door open. Thus, this embodiment of the invention has advantages over the previous embodiments in providing the handicapped person with a way of grasping door knobs while still positioned a short distance from the door and without having to physically engage a grasping member with the door knob.

A significant feature of the present invention is that it is not necessary for the handicapped person to actually hold the door opening and closing device 50 in his hand in order to manipulate it during door opening and closing procedures. To this end, the principles of the invention contemplate providing various ways in which the door opening and closing device 50 is attached to the user's hand or wrist, or directly to a portion of the wheel chair 12, so that the handicapped person has both hands free to manipulate either the wheel chair or the crutches, as the case may be, during whatever movements as described above are necessary to open or close a door, again as the case may be.

Figure 12:
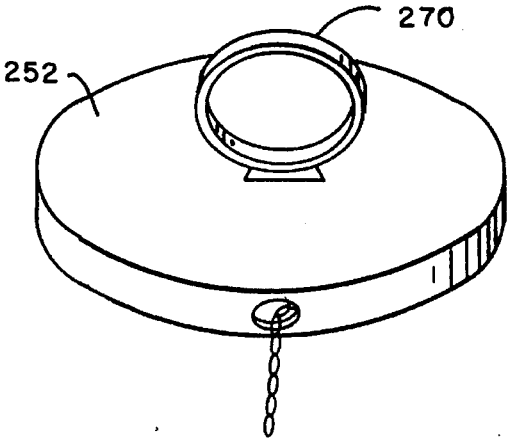
FIG. 12 is a perspective view of the housing portion of the door opening and closing device of the present invention showing one form of mounting the housing on a handicapped person's hand.

One embodiment of a means for attaching the door opening and closing device 50 to a user's hand is shown in FIG. 12, in which a suitable ring 270 is welded or otherwise suitably secured to one surface of the housing 252, the ring being of a size appropriate to slip over the thumb or finger of a user's hand. The ring 270 can be made adjustable in known manner if desired to render it applicable to different users.

Figure 13:
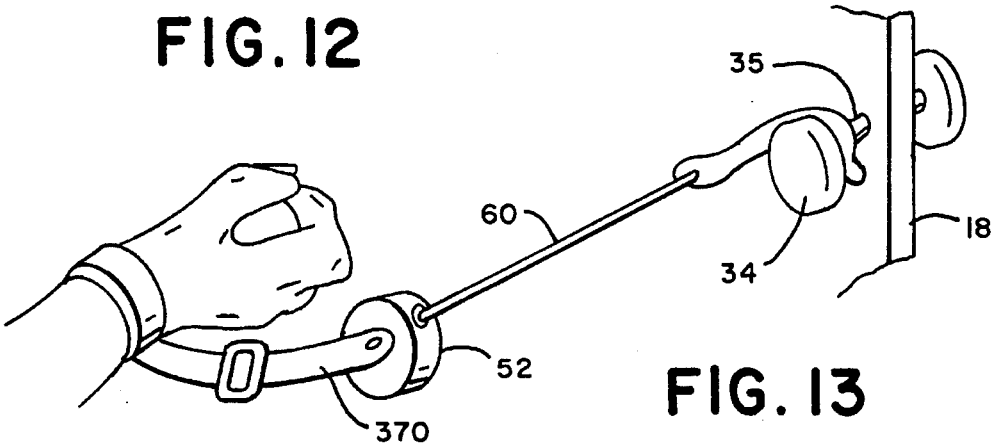
FIG. 13 is a view of still a further embodiment of the door opening and closing device of the present invention.

Another embodiment of a means for attaching the door opening and closing device 50 to a user's wrist is shown in FIGS. 7 and 13, in which one end of a suitable adjustable strap 370 is secured to a peripheral portion of the housing 52, as seen in FIG. 7, or the side portion of the housing 52, as seen in FIG. 13, the other end of the strap 370 being secured to the user's wrist. As seen in FIG. 6, it is possible to attach the strap 370 to a portion of the frame of the wheel chair 12, thereby leaving the user's hands entirely unencumbered by the device 50. The door opening and closing device is operated in the same manner as above described regardless of the manner in which it is secured to the user's hand, wrist or the wheel chair.

It is to be understood that the present invention is not to be considered as limited to the specific embodiments described above and shown in the accompanying drawings, which are merely illustrative of the best modes presently contemplated for carrying out the invention and which are susceptible to such changes as may be obvious to one skilled in the art, but rather that the invention is intended to cover all such variations, modifications and equivalents thereof as may be deemed to be within the scope of the claims appended hereto.

I claim:

1. A door opening and closing device adapted particularly for use by handicapped persons confined to a wheel chair who are unable to reach the door knob of a standard residential or commercial building door to easily open or close the door when approaching and after passing through the doorway in the wheel chair in a direction opposite to that in which the door opens, said door closing device comprising A. a generally cylindrical housing having a thickness and peripheral extent such that said housing can conveniently be held in the hand of a user, said housing having a peripheral opening, B. a reel rotatably mounted within said housing, C. an elongate flexible member wound on said reel and extending through said peripheral opening in said housing, D. resilient means mounted in said housing and operatively interconnected between said housing and said flexible member such that said resilient means is stressed in response to movement of said flexible member through said peripheral opening in said housing to withdraw said flexible member from said housing, whereby said resilient means will retract said flexible member back into said housing through said peripheral opening in response to the stress in said resilient means when the force withdrawing said flexible member from said housing is removed, and E. grasping means attached to the end of said flexible member, said grasping means including means for operatively engaging the shaft housing of the door knob behind said door knob without slipping off when said flexible member is pulled to open or close the door, whereby the handicapped person can catch said grasping means over the door knob shaft housing on the adjacent side of a closed door while moving the wheel chair backward away from the door to open the door, and can catch said grasping means over the door knob shaft housing on the opposite side of the door while passing through the doorway to pull the door closed after the wheel chair clears the path of the door.

2. A door opening and closing device as set forth in claim 1 wherein said means for engaging said door knob shaft housing comprises a hook having a configuration such that it will engage with said shaft housing and not slip off when said flexible member is pulled to open or close the door.

3. A door opening and closing device as set forth in claim 2 Wherein said hook has a shank portion that is generally elongate in configuration and is connected to said flexible member at one end thereof, and a hook portion that is approximately semicircular to define a substantially wide throat between the terminal end of said hook portion and the approximate juncture of said hook portion with said shank portion, said shank portion having a length generally sufficient to permit said hook portion to reach said shaft housing behind the door knob and engage said shaft housing, said throat being sufficiently wide to encompass the shaft housing of conventional door knobs.

4. A door opening and closing device as set forth in claim 1 wherein said grasping means comprises a claw having a configuration such that it will easily catch over the shaft housing of the door knob and not slip off when said flexible member is pulled to open or close the door.

5. A door opening and closing device as set forth in claim 4 wherein said claw comprises a central body member connected to the end of said flexible member and a plurality of resilient, generally hook shaped fingers connected to said body member, said fingers being normally biased to a relatively closed position in which they define an opening into said claw that is smaller than the diametral distance of conventional door knobs, said fingers being sufficiently resilient to spread apart sufficiently far, when said claw is pressed against the door knob, to permit said fingers to pass over the door knob and engage the back side thereof.

6. A door opening and closing device as set forth in claim 1 wherein

A. said resilient member comprises a strip of spring metal secured at one end to said reel, said strip of spring metal having a lateral curvature capable of imparting sufficient longitudinal rigidity to said strip of spring metal that it will not readily bend in the concave direction of said lateral curvature, so that a predetermined length of said strip can be rigidly extended from said housing, and B. said grasping means being a loop of flexible material attached to the free end of said strip of spring metal, said loop of flexible material having an opening large enough to enable it to be easily dropped over the door knob to engage the back side thereof.

7. A door opening and closing device as set forth in claim 1 wherein said housing includes means on one side thereof for attaching said housing to the back of a user's hand, thereby leaving his hand free to manipulate the turning wheel of the wheel chair while backing away from the door or passing through the doorway, as the case may be, said means for attaching said housing to the back of a user's hand comprising a ring secured to said housing, said ring being of a size appropriate to slip over the thumb or a finger of the user's hand.

* * * * *